US005891533A

United States Patent [19]

Pensero et al.

[11] Patent Number: 5,891,533

[45] Date of Patent: Apr. 6, 1999

[54] BASE FORM FOR DECORATIVE ARRANGEMENTS

[76] Inventors: Laurie A. Pensero, 20 Amy Ave.; JoAnne L. Pearson, 432 Fiore Dr., both of Utica, N.Y. 13502

[21] Appl. No.: 840,736

[22] Filed: Apr. 16, 1997

[51] Int. Cl.[6] ..... D04D 7/10

[52] U.S. Cl. ..... 428/5; 428/10; 428/27; 428/34.1

[58] Field of Search ..... 428/10, 5, 27, 428/34.1

[56] References Cited

U.S. PATENT DOCUMENTS 4,957,784 9/1990 Ripamonti ..... 428/5

5,506,009 4/1996 Stolzman et al. ..... 428/10

*Primary Examiner*—Henry F. Epstein

*Attorney, Agent, or Firm*—Robert O. Wright

[57] ABSTRACT

A base form for use in making decorative baskets and other art form arrangements has a plastic grid sheet on which is sewn a series of concentric circles of loops made from narrow strips of a thin plastic film. The loops are formed with their bases abutting and the bases sewn to the plastic grid sheet. The grid sheet is formed to fit the particular application. Flowers and other decorative notions may be inserted into the grid material and loops to form a pleasing arrangement.

16 Claims, 7 Drawing Sheets

BASE FORM FOR DECORATIVE ARRANGEMENTS

BACKGROUND OF INVENTION

This invention relates generally to a base form to replace "Easter grass" in baskets and for use in making decorative arrangements of flowers, crafts and the like. More specifically it relates to a prefabricated assembly of a base form and decorative loops of strip material secured on one surface thereof which may be used by florists, crafters and others to construct decorative basket arrangements of flowers, wall hangings, table decorations and other decorative items using flowers, craft items, notions, balloons, etc.

Florists and craft people have used plastic/wire grids; blocks of styrofoam and "Oasis"; needle point blocks; and other base materials in constructing bouquets, wall hangings, table centerpieces, and other attractive decorative items for many years. Each base form has been particularly suited for a specific end use and usually served its purpose well. For certain applications several base forms had to be combined to yield the desired end result.

PRIOR ART

U.S. Pat. 5,506,009 to Stolzman et al shows a decoration in which a sheet of plastic grid material has a series of ribbons poked through selected apertures by the user to form a decorative wreath or the like to which may be added flowers and notions. This while resulting in a pleasing end product has required considerable time and dexterity by the artist creating the decoration just to construct the base form for the ultimate decoration. While offering the creative artist unlimited options, for the commercial florist and decorator it is much too time consuming and hence uneconomical to use.

OBJECTS AND SUMMARY OF INVENTION

Accordingly it is an object of the present invention to provide a prefabricated base form for use by florists, crafters and others that combines several of the best features of prior base forms in one unit.

It is another object of the present invention to provide a base form that in and of itself presents a pleasing artistic appearance in a ready to use format.

It is a still further object of the present invention to provide a base form that is not only pleasing to look at but offers several ways of adding other decorative items such as flowers, notions, momentoes, jewelry and the like.

These and other and further objects are accomplished in one embodiment by forming concentric circles of closely adjacent loops of plastic film and sewing them onto a plastic grid sheet to substantially cover one surface thereof resulting in a base form having a pleasing fluffy surface appearance much like "Easter grass" and a grid backing sheet in which flowers and other items may be inserted as desired.

BRIEF DESCRIPTION OF THE DRAWINGS

FIG. 1 is a view of a base form according to the present invention positioned in a basket to form the foundation for a decorative "Easter" basket of eggs, flowers and the like;

DESCRIPTION OF PREFERRED EMBODIMENTS

Figure 1:
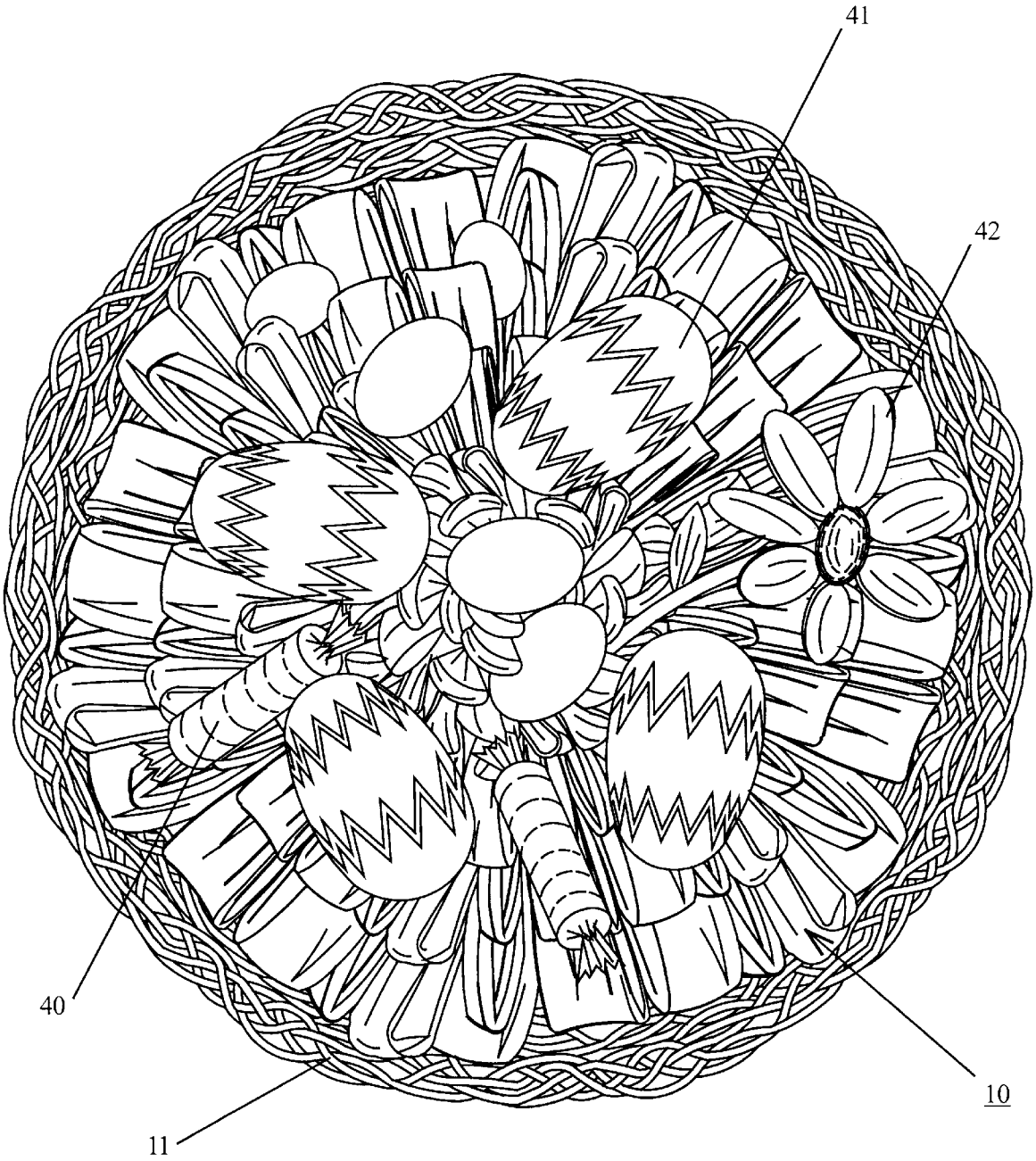

Referring now to FIG. 1 there is shown a base form member 10 according to the present invention positioned in a basket 11 with candy 40, eggs 41, and flowers 42 inserted therein to make a decorative "Easter basket" arrangement. As may be seen in FIG. 2 base form member 10 comprises a plastic grid sheet 12 having a series of generally square holes 14 each about ⅛th of an inch on a side. Sheet 12 is usually molded in a rectangular form with horizontal and vertical rows of holes but other patterns may obviously be used. The particular size of sheet 12 is chosen to best fit a particular application such as shown in FIG. 1. Thus it may be rectangular, circular, eliptical, or any other desired shape and size.

Figure 3:
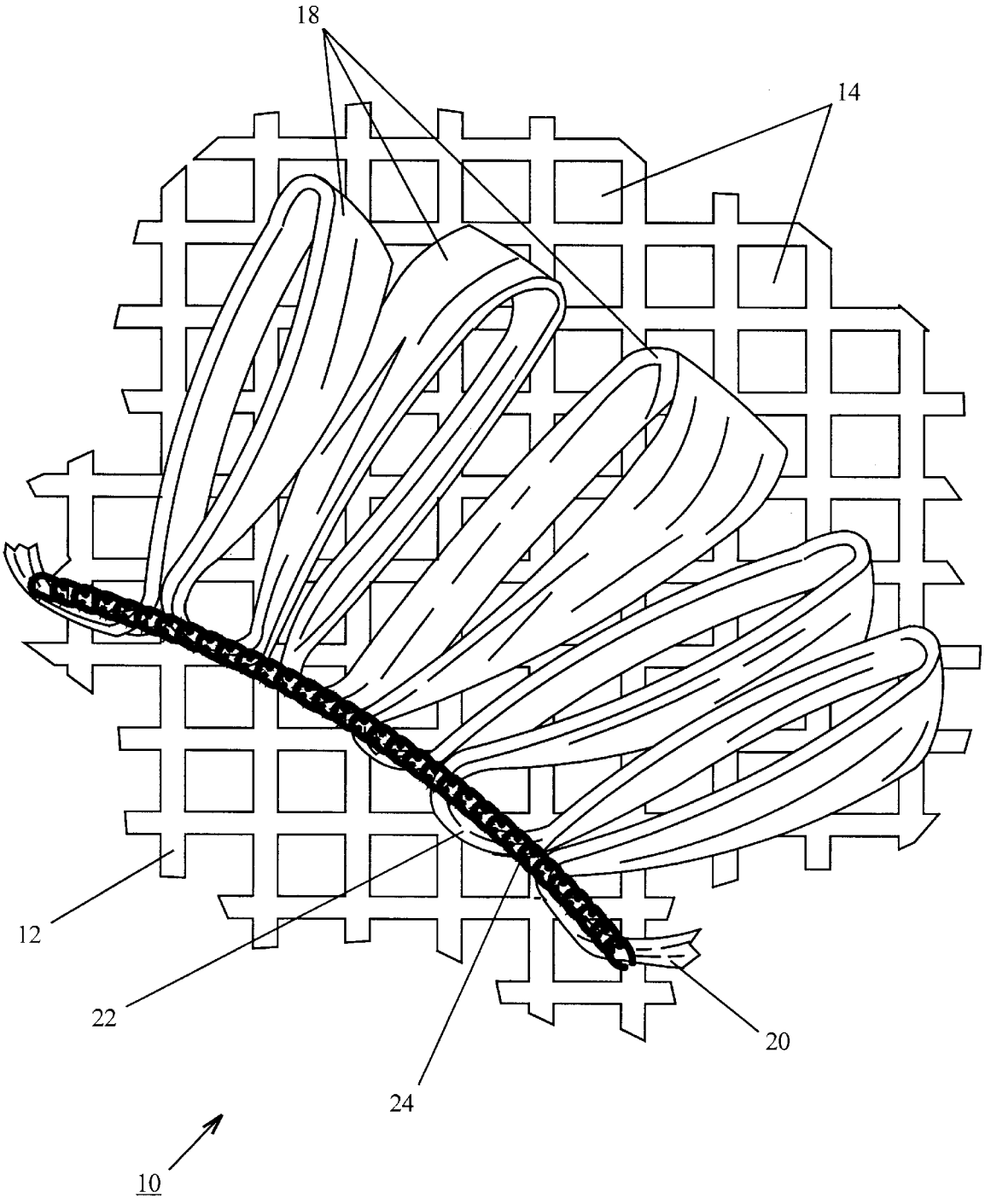
FIG. 3 is a partial view of a series of loops sewn on a grid sheet.
Figure 4:
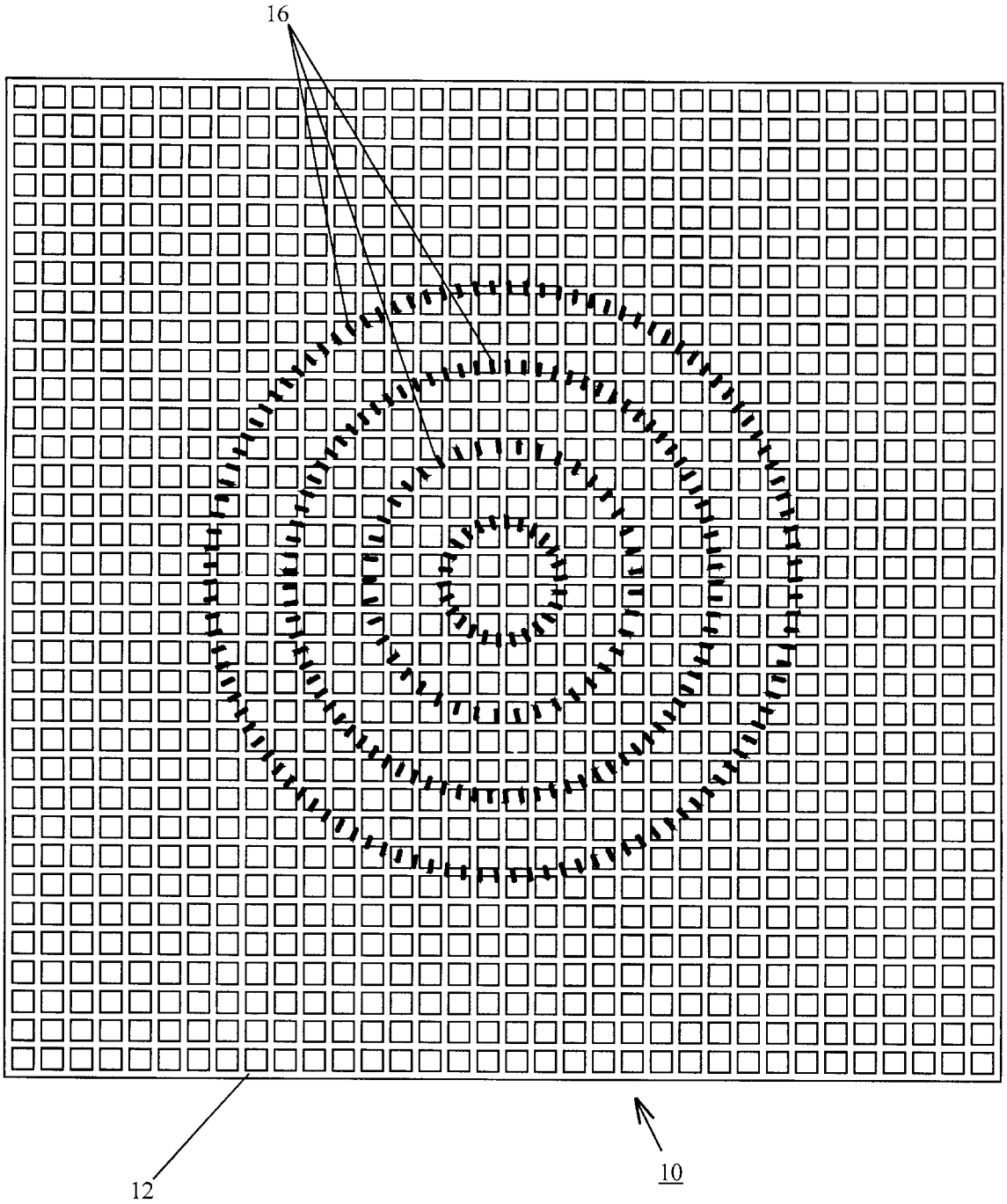
FIG. 4 is a rear elevational view of the embodiment of FIG. 2 showing the sewing pattern.

As may be seen best in FIGS. 3 & 4 a number of concentric rings 16 of loops 18 formed from a length of thin clear plastic film 20 are sewn to one side of the grid sheet 12. The loops 18 are formed from a long length of plastic film 20 by folding a series of generally equal lengths of film together to form loops 18 and sewing the bases 22 of the folded loops 18 onto the grid sheet 12 in a circle. The sewing 24 may use any appropriate thread such as Nylon or cotton and a standard industrial chain or other stitch. The plastic grid 12 being quite thin and having a large number of holes 14 readily permits this method of securing the loops of material to the grid sheet.

The loops 18 may be any appropriate length and made from a range of material widths but in a preferred form are about two inches long and are formed from strips of film about two inches wide. When made from a clear plastic they form a ruffled or crinkle surface that tends to reflect the ambient light resulting in a pleasing base surface appearance. Obviously the loops 18 may be made from a wide variety of colors of plastic film as well as other materials such as ribbons, lace, netting, paper and the like. The specific material and color are chosen for the particular surface color and effect desired in the final application. Different colors and materials may even be used in each different circle.

Figure 2:
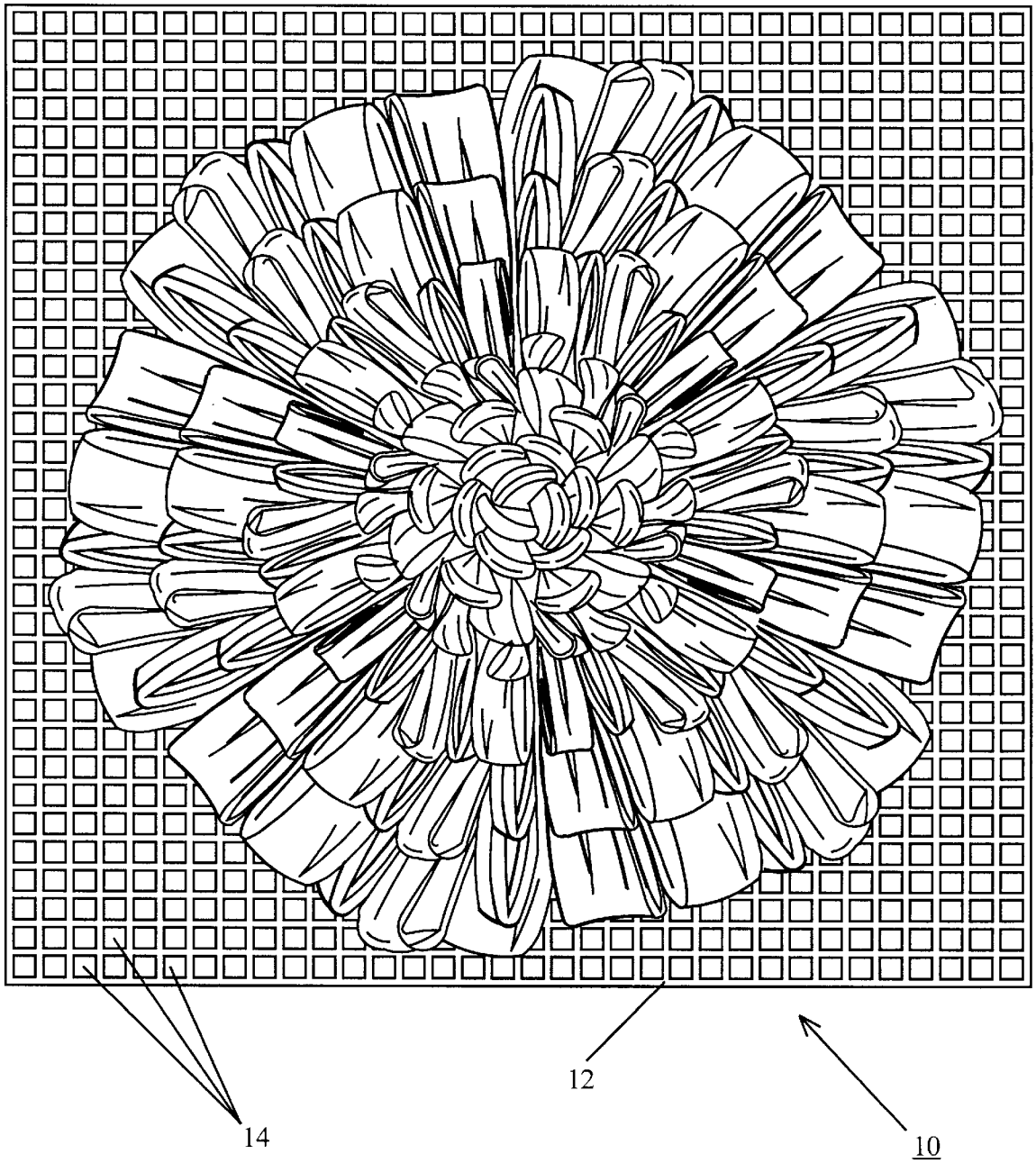
FIG. 2 is front elevational view of a base form according to the present invention.

As shown in FIGS. 2 & 4 the loops are sewn in a series of four concentric circles from a small diameter one in the center to the larger diameter ones at the outer edges. In this fashion substantially the entire surface of the grid 12 will be decoratively covered. Depending on the size of the grid 12 and the density of loops desired the number of circles will be increased or decreased.

Figure 5:
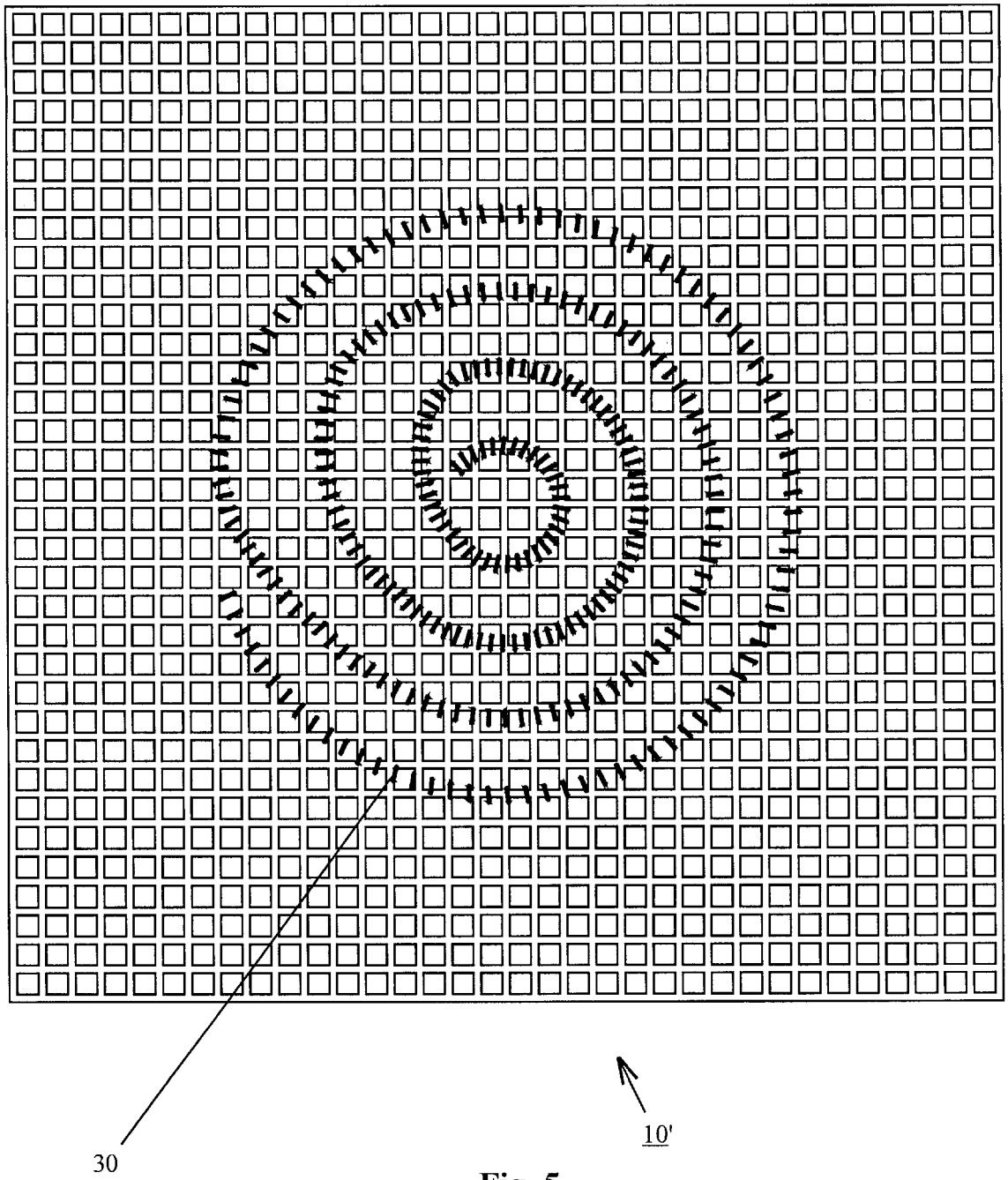
FIG. 5 is a view similar to FIG. 4 showing another embodiment of the present invention.
Figure 6:
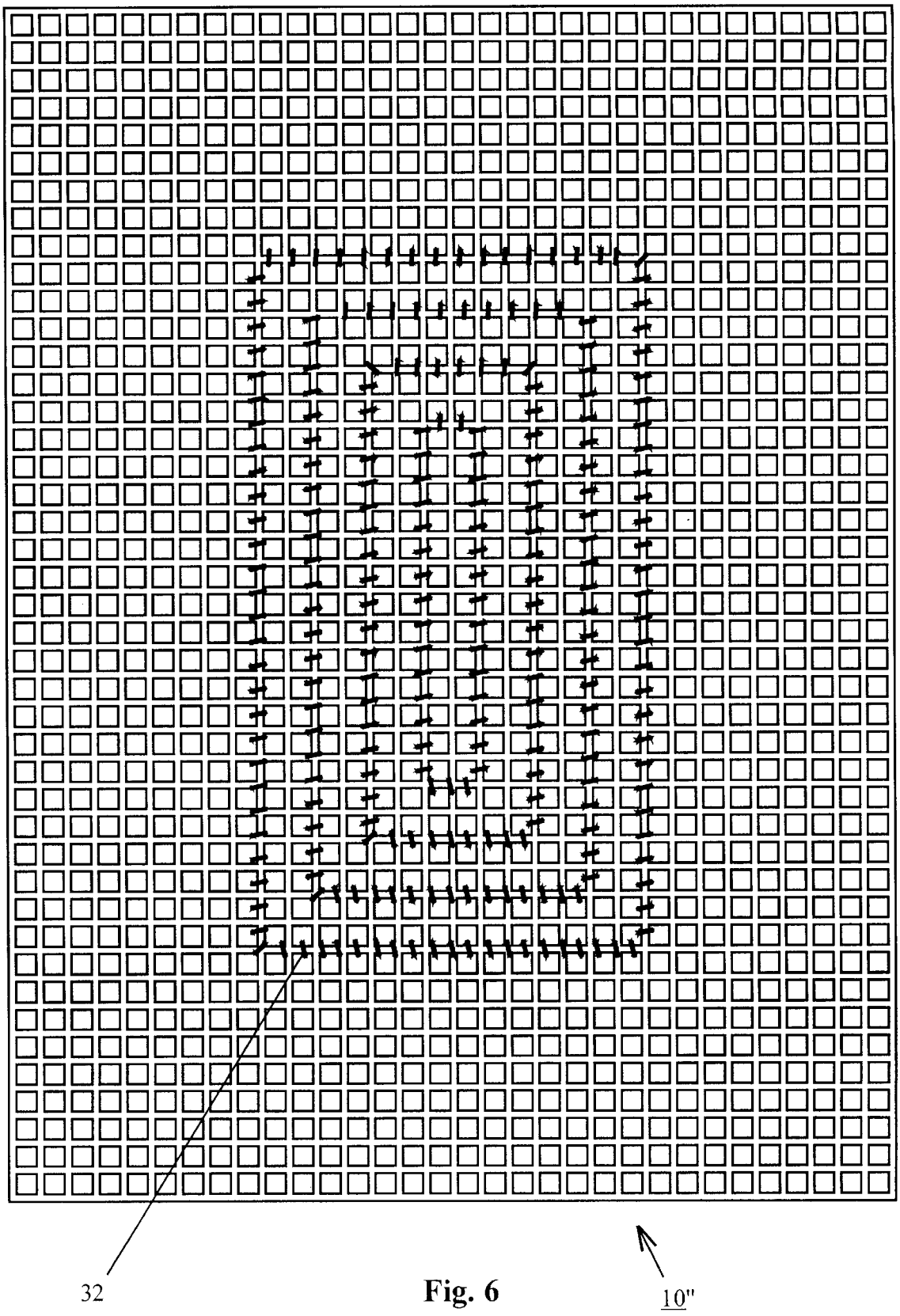
FIG. 6 is a view similar to FIG. 4 showing a still further embodiment of the present invention.

FIG. 5 shows base form 10' with a spiral pattern 30 which may be preferred for some applications. Other applications may be best met with a rectangular pattern 32 as shown on base form 10" in FIG. 6. In addition to varying the patterns of the sewn loops the base grid sheet may take different forms such as rings, hearts, partial spheres and the like.

Grid sheet 12 in addition to having loops 18 secured thereto provides a means for holding flowers, and other notions via the holes 14. Holes 14 may be round, square, and/or slits of any desired size. Variations in grid pattern and size may be used as required by a particular application.

Referring again to FIG. 1 basket 11 contains in addition to base form 10 a quantity of eggs, candy, flowers and other decorative items. Base form member 10 positioned within the basket body with its series of concentric circles 16 of loops 18 sewn thereon, provides not only a decorative grass surface but also a grid sheet into which flowers 42 and the other decorative items may be inserted. By threading the flower stems through the loop covered surface into holes 14 they are fixed in the desired position within the arrangement. With applicants base form member 10 all a florist or artist has to do to make an attractive arrangement is cut the sheet 10 to fit the basket(if necessary), insert the desired flowers etc. and the arrangement, complete with a grass or ruffled decorative surface, is done.

By varying the width of the strips of material used to make the loops 18, and the material itself, the surface effect may be varied to look like "Easter grass", a bed of ruffled ribbons, or almost any other effect.

Figure 7:
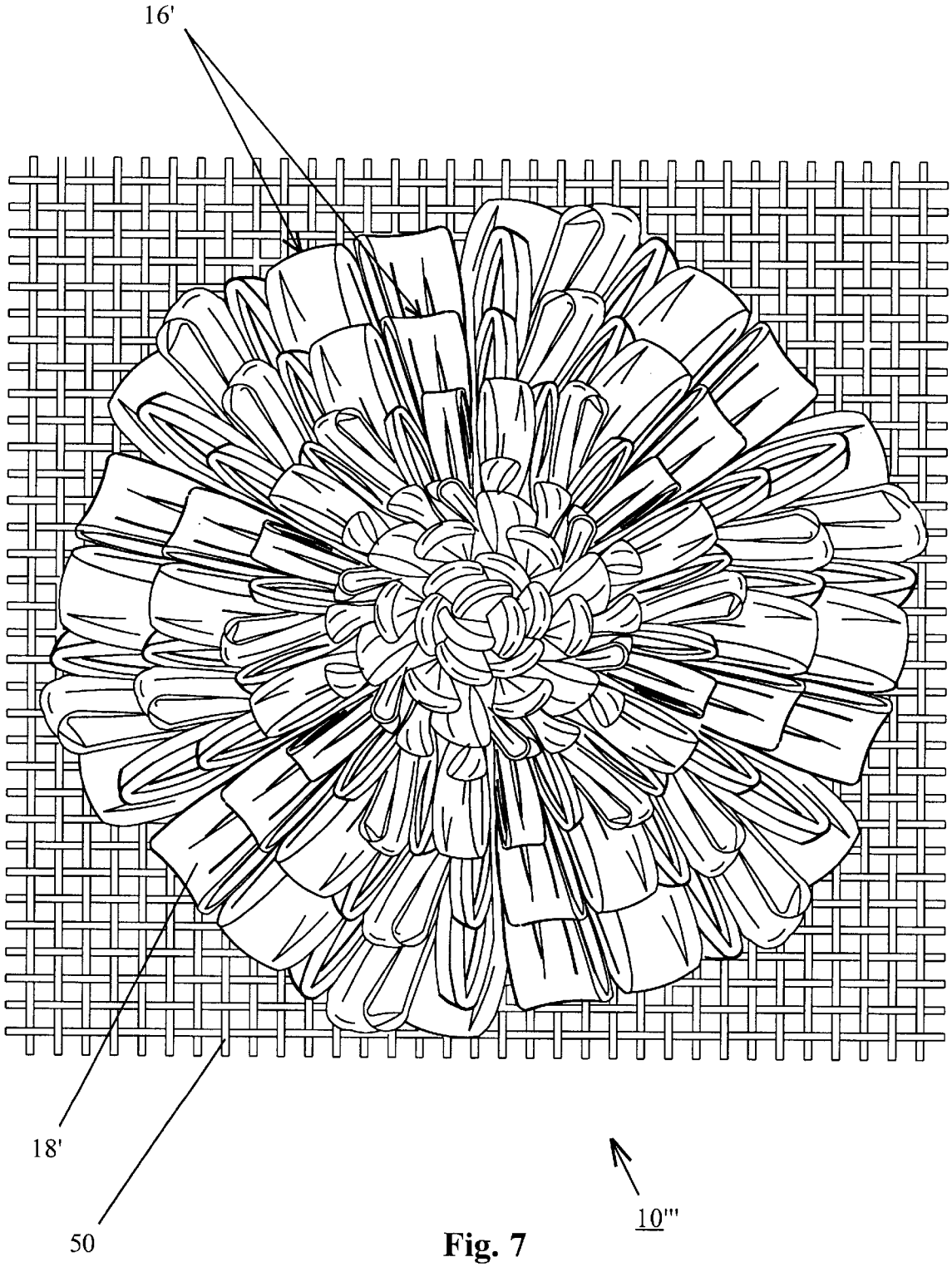
FIG. 7 is a front elevational view of another embodiment of the present invention.

FIG. 7 shows another embodiment in which base form member 10''' is made from a wire mesh 50. Mesh size may be varied but again a preferred form has apertures of approximately one eighth inch square. As in FIG. 1 four circles 16' of loops 18' are sewn to one side of the mesh 50. Base form member 10''' may be preferred for some applications over plastic base form 10.

While there are given above certain specific examples of this invention and its application in practical use, it should be understood that they are not intended to be exhaustive or to be limiting of the invention. On the contrary, these illustrations and explanations herein are given in order to acquaint others skilled in the art with this invention and the principles thereof and a suitable manner of its application in practical use, so that others skilled in the art may be enabled to modify the invention and to adapt and apply it in numerous forms each as may be best suited to the requirement of a particular use.

We claim:

1. A prefabricated base form covered on one side with decorative loops of a continuous strip material for use in making decorative arrangements of flowers, crafts, balloons and other notions for baskets, wall hangings, table decorations and other art forms, which comprises in combination:

a generally planar deformable sheet of first material having a plurality of small openings formed therein throughout the surface thereof;

said openings being sized to receive therein stems and fasteners of decorative flowers, crafts, balloons and other notions;

at least one continuous length of thin ribbon second material formed into a series of short individual loops of material one after the other;

each of said individual loops of said series of short individual loops having a base portion and a tip portion;

said second material being fixed to one side only of said sheet of deformable first material by securing the base portions of each of said series of individual loops of thin ribbon second material closely adjacent each other in a predetermined pattern to said sheet of first material; and said second material being chosen so that the tip portions of said short individual loops form a decorative surface covering over said one side only of said first material.

2. A base form as claimed in claim 1 wherein said base portion of each of said loops of said series of loops is sewn onto said deformable first material.

3. A base form as claimed in claim 2 wherein said at least one length of second material is formed into a spiral of individual loops starting at the center of said deformable first material and extending to the outer edges thereof.

4. A base form as claimed in claim 2 wherein said at least one length of second material is formed into concentric circles of individual loops;

said circles increasing in diameter from the center to the outer edges of said deformable first material.

5. A base form member as claimed in claim 4 wherein said second material is a narrow strip of material approximately two inches wide and said loops are approximately two inches long.

6. A base form as claimed in claim 4 wherein said second material is a film of clear plastic material.

7. A base form as claimed in claim 4 wherein said second material is a selected decorative material.

8. A base form as claimed in claim 2 wherein said second material is formed into a series of rectangular patterns formed on one side of said deformable first material so as to cover substantially the entire surface thereof.

9. A base form as claimed in claim 2 wherein said first material is a mesh formed of fine wires.

10. A prefabricated base form member covered on one side with decorative loops of a continuous strip material for use in making decorative arrangements of flowers, crafts, balloons and other notions, for making baskets, wall hangings, table decorations and other art forms, which comprises in combination:

a deformable plastic sheet having a plurality of small apertures formed throughout the surface thereof;

a continuous length of narrow thin film material;

said continuous length of thin film material being formed into a series of closely adjacent loops having base and tip portions;

said base portions of said series of loops being sewn onto said plastic sheet so that said loops extend outwardly from one side of said plastic sheet; and said series of loops being formed into a predetermined pattern covering the surface of said plastic sheet as they are sewn onto said plastic sheet.

11. A base form member as claimed in claim 10 wherein said apertures comprise a series of rows of small rectangular holes forming a grid sheet.

12. A base form member as claimed in claim 10 wherein said apertures comprise slits formed in said plastic sheet.

13. A base form member as claimed in claim 10 wherein said thin film material is a clear plastic.

14. A base form member as claimed in claim 10 wherein said thin film material is a decorative ribbon material.

15. A base form member as claimed in claim 10 wherein said predetermined pattern comprises a series of concentric circles.

16. A base form member as claimed in claim 10 wherein said predetermined pattern is a series of rectangles spaced about one side of said plastic sheet.

* * * * *